United States Patent [19]

Onari et al.

[11] Patent Number: 4,899,280

[45] Date of Patent: Feb. 6, 1990

[54] ADAPTIVE SYSTEM FOR CONTROLLING AN ENGINE ACCORDING TO CONDITIONS CATEGORIZED BY DRIVER'S INTENT

[75] Inventors: Mikihiko Onari, Kokubunji; Teruji Sekozawa, Kawasaki; Motohisa Funabashi, Sagamihara, all of Japan

[73] Assignee: Hitachi, Ltd., Tokyo, Japan

[21] Appl. No.: 179,542

[22] Filed: Apr. 8, 1988

[30] Foreign Application Priority Data

Apr. 8, 1987 [JP] Japan ..... 62-84743

[51] Int. Cl.[4] ..... F02B 3/00; F02D 41/34

[52] U.S. Cl. ..... 364/431.05; 364/431.07; 123/339; 123/492; 123/493

[58] Field of Search ..... 364/431.05, 431.07, 364/431.03, 431.04, 424; 123/339, 419, 422, 423, 480, 492, 493

[56] References Cited

U.S. PATENT DOCUMENTS

| | | | |
|---|---|---|---|
| 4,309,971 | 1/1982 | Chiesa et al. | 364/431.05 |
| 4,366,541 | 12/1982 | Mouri et al. | 364/431.05 |
| 4,501,250 | 2/1985 | Omori et al. | 123/486 |
| 4,509,489 | 4/1985 | Hasegawa et al. | 123/489 |
| 4,526,153 | 7/1985 | Hasegawa et al. | 123/480 |
| 4,541,052 | 9/1985 | McCulloch | 364/431.07 |
| 4,625,697 | 12/1986 | Hosaka | 123/480 |
| 4,635,200 | 1/1987 | Egami et al. | 364/431.07 |
| 4,639,870 | 1/1987 | Otobe et al. | 364/431.04 |
| 4,698,765 | 10/1987 | Abe et al. | 123/489 |
| 4,715,344 | 12/1987 | Tomisawa | 123/416 |
| 4,729,361 | 3/1988 | Otobe et al. | 364/431.05 |
| 4,745,553 | 5/1988 | Reven et al. | 364/431.04 |

OTHER PUBLICATIONS

Patent Abstracts of Japan, vol. 6, No. 220 (M-169) [1098], 5th Nov. 1982, & JP-A-57 126 534 (Nippon Denso K.K.) 06-08-1982.

*Primary Examiner*—Parshotam S. Lall
*Assistant Examiner*—V. N. Trans
*Attorney, Agent, or Firm*—Fay, Sharpe, Beall, Fagan, Minnich & McKee

[57] ABSTRACT

An adaptive control system for categorized engine conditions is disclosed in which the engine conditions to be controlled are discriminated and classified in accordance with the driver's intent and the vehicle operating conditions. It is decided that a given engine control condition is continued or the transition is under way between different control conditions as a history judgement, and a vehicle operation parameter is determined in accordance with the determined history. At the same time, in accordance with the control condition decided and classified, an operating signal is applied to the engine with an operating parameter thus determined and the result of engine control response is observed to update the adaptive parameter.

11 Claims, 7 Drawing Sheets

FIG. 3

| VEHICLE CONDITION \ DRIVER'S INTENT | TORQUE TRANSMISSION | BRAKING $\theta_{br}>0$ $\theta_{ac}=0$ | TRANSIENT · COASTING $\theta_{br}=0$ $\theta_{ac}=0$ | $\theta_{AC}>0$ DECELERATION $\dot{\theta}_{ac} \leq \dot{\theta}_{acd}$ $N \geq N_d$ | $\theta_{AC}>0$ RUNNING $\dot{\theta}_{acd}<\dot{\theta}_{ac}<\dot{\theta}_{aca}$ | $\theta_{AC}>0$ ACCELERATION $\dot{\theta}_{ac} \geq \dot{\theta}_{aca}$ $N \leq N_a$ |
|---|---|---|---|---|---|---|
| RESET | OFF | 4 IDLE SPEED CONTROL | | 1 A/F CONTROL (RACING) | | |
| RUNNING | OFF | 4 IDLE SPEED CONTROL | | 1 A/F CONTROL (RACING) | | |
| REST $v=0$ | ON | MT : — ENGIN STALL<br>AT : ISC | | — | | 2 ACCELERATION CONTROL |
| ACCELERATION RUNNING DECELERATION $v>0$ | ON | | | 3 DECELERATION CONTROL | 1 A/F CONTROL (CRUISING CONTROL SELECTION) | 2 ACCELERATION CONTROL |

$\theta_{ac}$ : ACCELERATOR PEDAL ANGLE
$\dot{\theta}_{ac}$ : ACCELERATION RATE
$\theta_{br}$ : BRAKE PEDAL ANGLE
$v$ : VEHICLE SPEED
N : ENGINE SPEED
AFFIXED a : CONSTANT RELATING TO ACCELERATION
AFFIXED d : CONSTANT RELATING TO DECELERATION

ADAPTIVE SYSTEM FOR CONTROLLING AN ENGINE ACCORDING TO CONDITIONS CATEGORIZED BY DRIVER'S INTENT

BACKGROUND OF THE INVENTION

The present invention relates to a control system suitable for making a computer program in a vehicle engine control unit match the engine, chassis and driving environment and for adaptive correction thereof in accordance with secular or environmental variations of the vehicle, or more in particular to an adaptive control system suitably capable of controlling the engine under different control conditions and under the transitions among the control conditions.

The sole function of conventional program of engine control systems has been, as described in "Systems and Control", Vol. 24, No. 5, pp. 306 to 312, to supply a fuel injector and an ignition timing control unit, periodically with the results of calculations based on new observation data. In these systems, the idle engine speed control has been the only independent functional program.

These prior art control systems are based on the observation values at respective time points for control of a vehicle engine, but includes no means for evaluating the engine control conditions with the passage of time or no means for categorizing the engine conditions while the engine is running. As a result, the controllability, and hence the riding quality or drivability in the transition say, "from acceleration to deceleration" is accompanied by a problem. Also, it takes a long time to make a control program developed for a predetermined engine control model match the engine in a vehicle.

SUMMARY OF THE INVENTION

Accordingly, the object of the present invention is to provide a control system which permits comfortable driving under all control conditions of an electronically-controlled engine and is capable of improving the control in each engine control condition or in he process of transition between engine control conditions for each vehicle and for each driving environment and/or driver.

According to the present invention, there is provided an engine control system that discriminates engine control conditions, adjusts parameters of the control system for each control condition and adjusts the time passage of the coupling degree between the parameters in the transition between the conditions.

The engine control conditions are classified into four types including (1) A/F control, (2) acceleration control, (3) deceleration control and (4) idle speed control. Transitions available between these four conditions are indicated by circles in the transition matrix shown in Table 1 below.

TABLE 1

| | Arrival | | | |
|---|---|---|---|---|
| Departure | A/F control | Accel. control | Decel. control | Idle speed control |
| A/F control | | o | o | — |
| Accel. control | o | | o | — |
| Decel. control | o | o | | o |
| Idle speed control | — | o | — | |

On the basis of the accelerator pedal angle, brake pedal angle, engine speed and vehicle speed (vehicle conditions) and on/off of the torque transmission mechanism, the computer discriminates the four control conditions of the engine and executes the control for each condition. As the result of the control, the air-fuel ratio is measured at an exhaust gas sensor and the measurement is compared with a target air-fuel ratio for each condition for evaluation (the mixing ratio of fuel to air is used instead of the air-fuel ratio in computation). If the difference between the measurement and a target air-fuel ratio is considerable, the compensation factor for the mixing ratio for each control condition is adaptively corrected and updated.

For switching the mixing ratio compensation factors between engine control conditions in transition from one to the other, a method suitable for each particular transition is taken while adaptively correcting and updating the parameters involved.

FIG. 3 shows the engine operating conditions discriminated and categorized as mentioned above. The engine operating conditions may be represented in terms of the corresponding engine control methods.

The vehicle conditions are roughly divided into a rest condition and a running condition. The driver's intents are discriminated on the basis of six different driver actions including the engaging or disengaging of the torque transmission mechanism, the depression of the brake pedal, non-depression of the brake pedal and the accelerator pedal, the depression of the accelerator pedal, the depressed accelerator pedal at rest and the restored accelerator pedal.

When the torque transmission mechanism is on (engaged) and the accelerator pedal is depressed, an engine control for the acceleration requirement is performed. With the vehicle running, when the accelerator pedal is released and the brake pedal is depressed, a deceleration control is performed. At this time, when the accelerator pedal is released and the engine speed is excessively high, a fuel cut-off control is performed. In order to discriminate between the deceleration control and the fuel cut-off control, the engine speed is detected as an additional parameter.

In the running condition, if the vehicle is neither accelerated nor decelerated, an air-fuel ratio control is performed to maintain the air-fuel ratio at a desired value.

Now, the depression and release of the brake pedal can be discriminated by the signal $\theta_{br}$ from the brake pedal angle detector 35.

When the torque transmission mechanism is off, an idle speed control comes into action to control the engine speed to maintain it at a desired value. At this time, if the accelerator pedal is depressed, the switching to the previously mentioned air-fuel ratio control is effected despite the engine is racing.

The method of discriminating and classifying the conditions of the vehicle and the intents of the driver to select the proper engine control method (operating condition) is well suited to progressively deal with the diverse requirements of the user of the vehicle and the introduction of new techniques which meet the requirements. To the design and development engineer as well as to persons who match the engine control methods with the actual vehicle (the adjustment of the parameters), this means an advantage of understanding to understand only the engine control method corresponding to the required category. Thus, a modification of the computer program requires only the modification of some modules and so on.

BRIEF DESCRIPTION OF THE DRAWINGS

FIG. 3 is a diagram showing the relationship between the vehicle conditions and the methods of engine control corresponding to the driver's intent.

DESCRIPTION OF THE PREFERRED EMBODIMENTS

Figure 1:
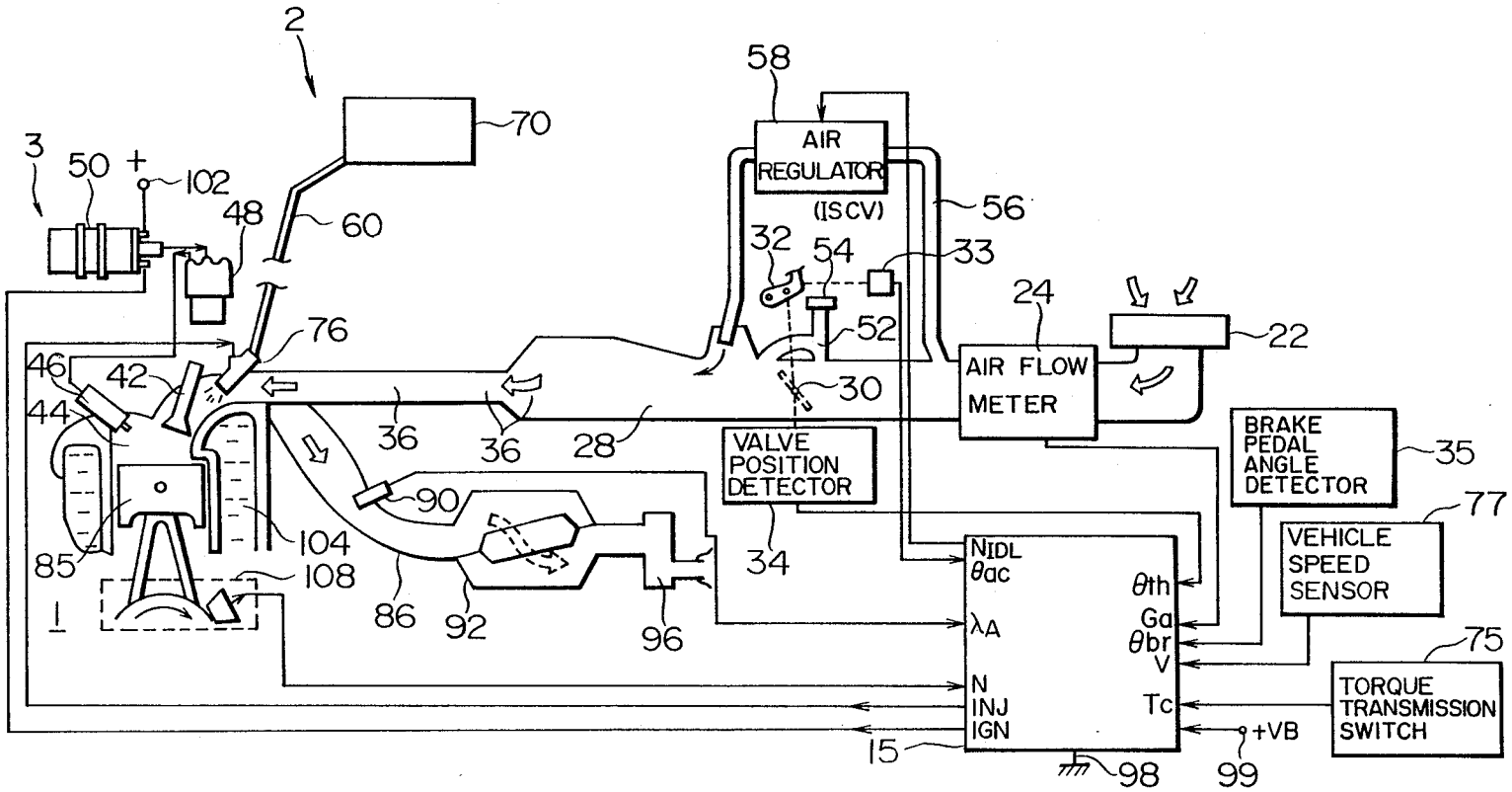
FIG. 1 is a diagram showing a configuration of an engine system using a condition discriminating type control system according to the present invention.

The electronic engine control system according to the present invention will now be described by way of embodiment with the aid of accompanying drawings. FIG. 1 systematically shows a typical example of the structure of an electronic engine control system according to the present invention. Air sucked through an air cleaner 22 is passed through an air flow meter 24 to measure the flow rate thereof, and the air flow meter 24 delivers an output signal Ga indicating the flow rate of air to a control circuit 15.

The air flowing through the air flow meter 24 is further passed through a throttle chamber 28, an intake manifold 36 and a suction valve 42 to the combustion chamber 44 of an engine 1. The quantity of air inhaled into the combustion chamber 44 is controlled by changing the opening of a throttle valve 30 provided in the throttle chamber 28. The opening of the throttle valve 30 is detected by detecting the valve position of the throttle valve 30 by a throttle valve position detector 34, and a signal $\theta$th representing the valve position of the throttle valve 30 is supplied from the throttle valve position detector 34 to the control circuit 15. The position of an accelerator pedal 32 representing the amount of depression (angle) thereof is detected by an accelerator pedal position sensor 33 which in turn delivers a signal $\theta$ac representing the depression angle of the pedal 32 to the control circuit 15.

The opening of the throttle valve 30 is controlled by the accelerator pedal 32.

The throttle chamber 28 is provided with a bypass 52 for idling operation of the engine and an idle adjust screw 54 for adjusting the flow of air through the bypass 52. When the throttle valve 30 is completely closed, the engine operates in the idling condition. The sucked air from the air flow meter 24 flows via the bypass 52 and is inhaled into the combustion chamber 44. Accordingly, the flow of the air sucked under the idling condition is changed by adjusting the idle adjust screw 54. The energy created in the combustion chamber 44 is determined substantially depending on the flow rate of the air inhaled through the bypass 52 so that the rotation speed of the engine under the idling condition can be adjusted to an optimal one by controlling the flow rate of air inhaled into the combustion chamber 44 by adjusting the idle adjust screw 54.

The throttle chamber 28 is also provided with another bypass 56 and an air regulator 58 including an idle speed control valve (ISCV). The air regulator 58 controls the flow rate of the air through the bypass 56 in accordance with an output signal $N_{IDL}$ of the control circuit 15, so as to control the rotation speed of the engine during the warming-up operation and to properly supply air into the combustion chamber at a sudden change in, especially sudden closing of, the valve position of the throttle valve 30. The air regulator 58 can also change the flow rate of air during the idling operation.

The fuel from the fuel tank 70 is supplied under pressure to a fuel injector 76 through a fuel line 60, and an output signal INJ of the control circuit 15 causes the fuel injector 76 constituting fuel injection control device 2 with other electronic devices which are not shown in the drawing to inject the fuel into the intake manifold 36.

The quantity of the fuel injected by the fuel injector 76 is determined by the period for which the fuel injector 76 is opened and by the difference between the pressure of the fuel supplied to the injector and the pressure in the intake manifold 36 in which the pressurized fuel is injected. It is however preferable that the quantity of the injected fuel should depend only on the period for which the injector is opened and which is determined by the signal supplied from the control circuit 10. Accordingly, the pressure of the fuel supplied by the fuel pressure regulator (not shown) to the fuel injector 76 is controlled in such a manner that the difference between the pressure of the fuel supplied to the fuel injector 76 and the pressure in the intake manifold 36 is kept always constant in any driving condition.

As described above, the fuel is injected by the fuel injector 76, the suction valve 42 is opened in synchronism with the motion of a piston 85, and a gasoline mixture of air and fuel is sucked into the combustion chamber 44.

The mixture is compressed and fired by the spark generated by an ignition plug 46 so that the energy created through the combustion of the mixture is converted to mechanical energy.

The exhaust gas produced as a result of the combustion of the mixture is discharged into the open air through an exhaust valve (not shown), an exhaust pipe 86, a catalytic converter 92 and a muffler 96.

A $\lambda_A$ sensor 90 is provided in the exhaust pipe 86 to detect the fuel-air mixture ratio of the mixture sucked into the combustion chamber 44. An oxygen sensor ($O_2$ sensor) is usually used as the $\lambda_A$ sensor 90 and detects the concentration of oxygen contained in the exhaust gas so as to generate a voltage signal corresponding to the concentration of the oxygen contained in the exhaust gas. The output signal of the $\lambda_A$ sensor 90 is supplied to the control circuit 15.

The control circuit 15 has a negative power source terminal 98 and positive power source terminal 99 which are connected to the output circuit 12 (not shown) included in the control circuit 15.

In the event the control circuit 15 generates the signal IGN for causing the ignition plug to spark, the signal is delivered to the output circuit 12 to cause an IGN voltage to be applied to the primary winding of an ignition coil 50.

As a result, a high voltage is induced in the secondary winding of the ignition coil 50 and supplied through a distributor 48 to the ignition plug 46 so that the plug 46 fires to cause combustion of the mixture in the combustion chamber 44. The mechanism of firing the ignition plug 46 will be further detailed. The ignition plug 46 has a positive power source terminal 102, and the control circuit 15 also has an output circuit 12 for controlling the primary current through the primary winding of the ignition coil 50. The series circuit of the primary winding of the ignition coil 50 and the output circuit 12 is connected between the positive power source terminal 102 of the ignition coil 50 and the negative power source terminal 99 of the control circuit 15. When the output circuit is activated, electromagnetic energy is stored in the ignition coil 50, and when the output circuit 12 is cut off, the stored electromagnetic energy is released as a high voltage to the ignition plug 46. Thus, plug 46, distributor 48 and ignition coil 50 constitute ignition control device 3. The engine 1 is further provided with a rotational sensor 108 for detecting the angular position of the rotary shaft of the engine, and the sensor 108 generates a reference signal N in synchronism with the rotation of the engine, e.g. every 360° of the rotation.

A brake pedal angle detector 35 detects the position of a foot brake (not shown) and delivers signal $\theta$br to the control circuit 15 when the foot brake is depressed.

The output circuit has been discussed in connection with the energization of the ignitor coil 50 and fuel injection by fuel injector 76. The output circuit is also utilized for outputting the $N_{IDL}$ control signal to the air regulator 58.

Figure 2:
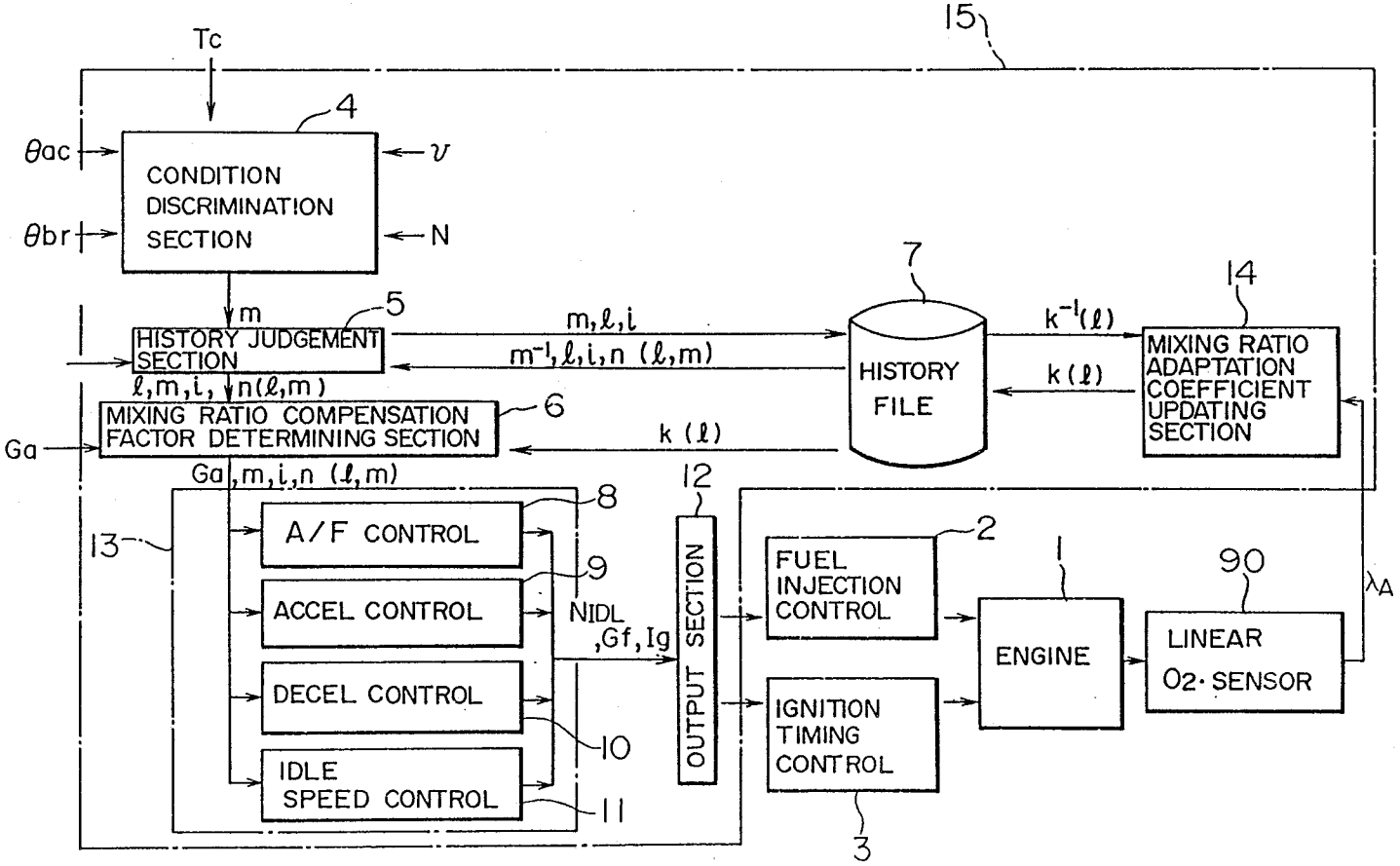
FIG. 2 is a block diagram showing a detailed functional configuration of the engine control system of FIG. 1.

FIG. 2 is a block diagram showing a detailed software configuration of the control system 15 making a centerpiece of a condition discriminating-type adaptive control method for engines according to an embodiment of the present invention.

In the configuration shown in FIG. 2, the control system comprises a condition discrimination section 4 supplied with various parameters representing driver's activity and condition of vehicle for deciding one of the engine control conditions shown in FIG. 3, a history judgement section 5 for comparing the control condition with a past control condition, a mixing ratio compensation factor determining section 6 for calculating a fuel-air mixing ratio compensation factor in accordance with the control condition decided, and a control section 13 including an air-fuel ratio control section 8, an acceleration control section 9, a deceleration control section 10 and an idle speed control section 11 selected in accordance with the result of condition discrimination.

Further, the control unit 15 includes an output section 12 for adjusting and outputting a signal mode of these control section outputs, from which a control signal is applied to a fuel injection control unit 2 including a fuel injector 76 and an ignition timing control unit 3 including an ignition plug 46.

The control unit 15 includes a mixing ratio adaptation factor updating section 14 for correcting and computing the adaptation factor of the mixing ratio in response to a detection value of a linear oxygen sensor 90 for measuring the amount of oxygen in the engine exhaust gas and a history file 7 for storing this value and applying data to the history judgement section 5 and the mixing ratio compensation factor determining section 6.

The condition discrimination section 4 detects the vehicle condition on the basis of the vehicle speed v produced from the vehicle speed sensor 77 and the engine speed N produced from the sensor 108, and also detects the driver's intent on the basis of the accelerator pedal angle $\theta$ac produced from the accelerator pedal position sensor 33, the brake pedal angle $\theta$br from the brake pedal angle detector 35 and the switching signal (on/off signal) from the torque transmission switch 75. The brake pedal angle $\theta$br may be replaced with equal effect by a stop switch including a contact adapted to be turned on/off at a predetermined angle as a displacement point.

The history judgement section 5 judges whether or not the engine control condition (m) decided at the time of the present sampling has changed from the condition ($m^{-1}$) at the last sampling by making comparison with the storage in the history file 7 containing the data on the last sampling times. m indicates the number of current engine control condition and $m^{-1}$ that of last engine control condition. The result of judgement at the history judgement section 5 is divided into two types: (1) the same control condition continued, and (2) under transition to a different control condition.

Figure 4:
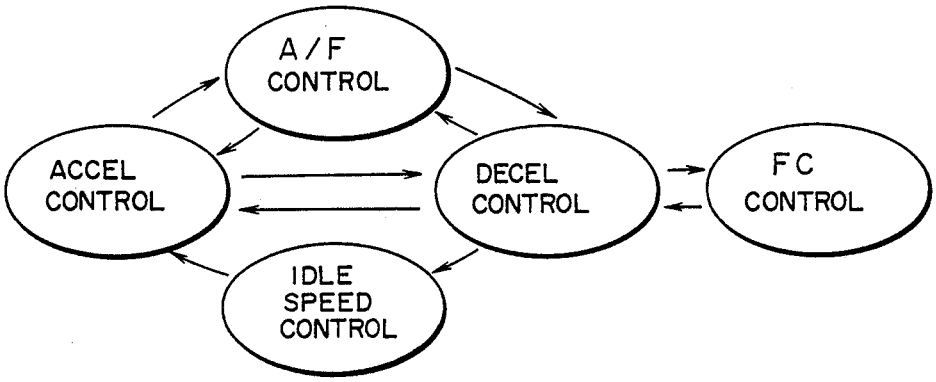
FIG. 4 is a condition transition diagram showing the transitions between engine control conditions.

A transition of engine control conditions is illustrated in FIG. 4. In FIG. 4, the engine control conditions include four types of air-fuel ratio control (hereinafter referred to as m=1), acceleration control (m=2), deceleration control (m=3) and idle speed control (m=4) and the transition stages between them.

Fuel cut (FC) control is also one of the engine control conditions but is included in the deceleration control. FC control starts from the deceleration control and returns to the deceleration control at the end thereof. The transition from FC control to acceleration control also passes through the logics of deceleration control.

The history judgement section 5 judges whether (1) the same control condition is continued, or (2) the engine is under transition from one control condition to another, and on the basis of the result of this decision, the mixing ratio compensation factor determining section 6 calculates the mixing ratio compensation factor $K_{MR}$ corresponding to the condition (1) or (2). The result of determination at the section 6 is applied to one of the air-fuel ratio control section 8, the acceleration control section 9, the deceleration control section 10 and the idle speed control section 11. In this manner, the amount of fuel injection and the ignition timing calculated at the control unit 15 are applied to the fuel injection control unit 2 and the ignition timing control unit 3 through the output section 12.

On the other hand, whether or not the result of combustion based on the mixing ratio compensation factor $K_{MR}$ has achieved a target mixing ratio $K_{TR}$ (l, Ga, N) (l: Condition before transition, Ga: Amount of intake air, N: Engine speed) is determined by measuring the combustion exhaust gas with a linear oxygen sensor (wide-range air-fuel ratio sensor) 90. The air excess rate thus measured $\lambda_A$ (Air-fuel ratio/stoichiometric air-fuel ratio) is compared with a target mixing ratio (fuel-air ratio) and the result of comparison is determined as a mixing ratio adaptation coefficient k(l), which coefficient is stored in the history file 7 for utilization in the calculation of the amount of fuel injection under the same engine control condition at the next and subsequent samplings.

Figure 5:
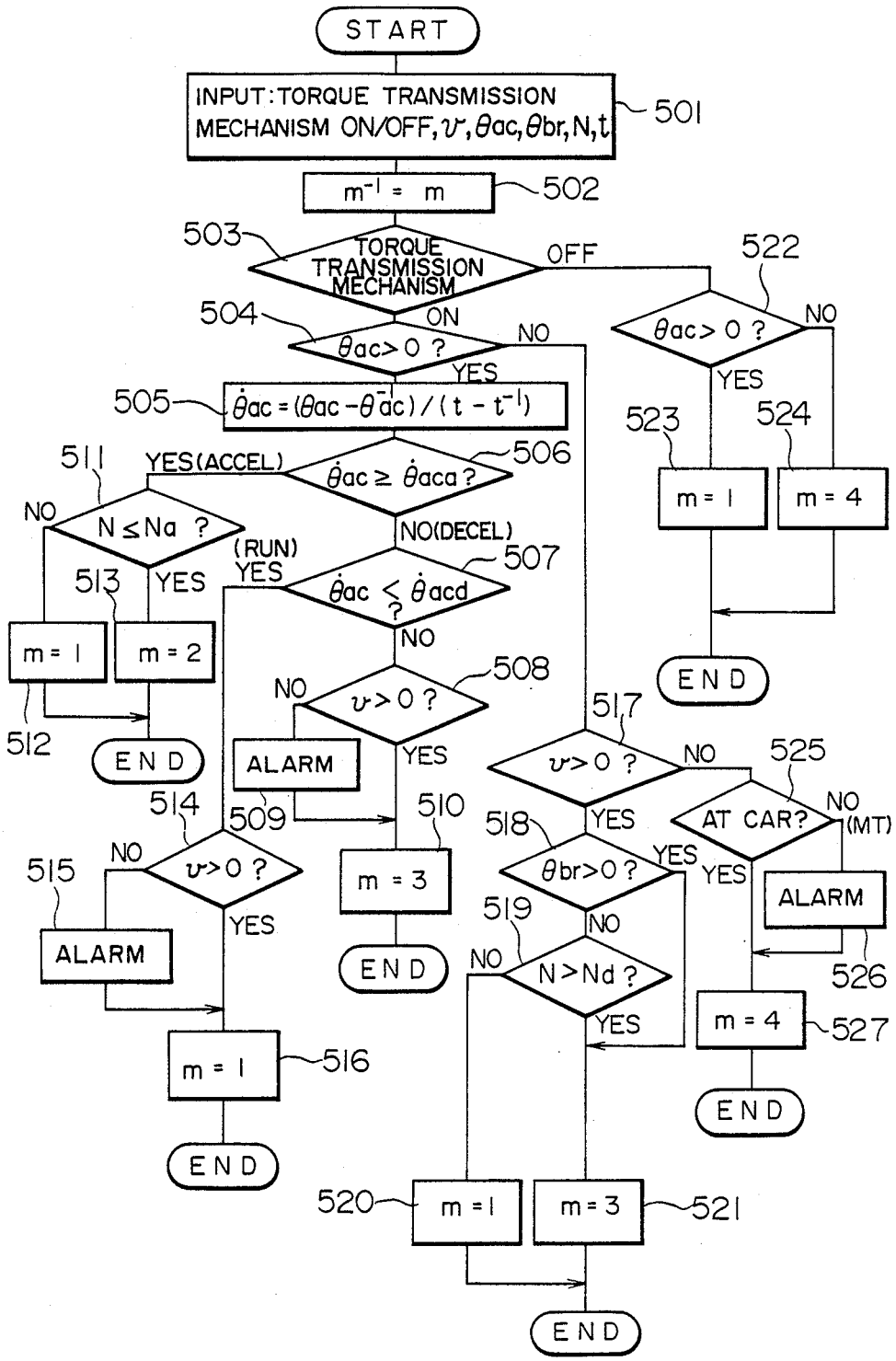
FIG. 5 is a flowchart for achieving the function of a condition discriminator 4 shown in FIG. 2.

Now, the processing operation of the control unit 15 for each functional block thereof will be explained in detail. FIG. 5 shows a flowchart for the condition discrimination section 4. This control condition discrimination section 4 is supplied with initial data including the on/off signal of the torque transmission mechanism, the vehicle speed v, accelerator pedal angle θac, brake pedal angle θbr, engine speed N and the time point t when the present sampling is read in the first place at step 501. The next step 502 indicates the engine control condition (m) one sampling time before as $m^{-1}$ for the convenience of program processing. If step 503 decides that the torque transmission mechanism is on, step 504 decides whether or not the accelerator pedal angle $\theta_{ac}$ is larger than "0". If the angle $\theta_{ac}$ is larger than zero, the process proceeds to the next step 505 for calculating the accelerator pedal angular speed $\theta_{ac}$ from $(\theta_{ac}-\theta_{ac}^{-1})/(t-t^{-1})$, where $\theta_{ac}^{-1}$ is the accelerator pedal angle read at the immediately preceding sampling time and $t^{-1}$ the time point of the immediately preceding sampling. The result of calculation at step 505 is compared with the maximum threshold value of accelerator pedal angle speed $\theta_{aca}$ at the next decision step 506, and if $\theta_{ac} \geqq \theta_{aca}$, step 511 compares the engine speed N with the maximum engine speed Na. If step 511 decides that $N \leqq Na$, it is decided that the engine control condition at that time point is acceleration (m=2) (step 513), and in other cases, that the air-fuel ratio control (m=1) is discriminated (step 512).

If step 506 decides that the relations $\theta_{ac} \geqq \theta_{aca}$ does not hold, step 507 compares the acceleration pedal angular speed $\theta_{ac}$ with the minimum threshold value of acceleration pedal angular speed $\theta_{acd}$, and if $\theta_{ac} \leqq \theta_{acd}$, step 514 decides that the air-fuel ratio control is discriminated (m=1) if the speed v is larger than zero.

If the decision at step 514 is "No", it indicates that the acceleration pedal angular speed $\theta_{ac}$ is not larger than the minimum threshold value of acceleration pedal angular speed $\theta_{acd}$ while the speed is "0", thereby representing some fault. As a result, step 515 raises an alarm and proceeds to the air-fuel control (m=1) (step 516) which is on the safe side.

If step 507 decides that the realtions $\theta_{ac} \leqq \theta_{acd}$ does not hold, step 508 decides whether v is larger than zero, and if the answer is "Yes", it is decided that the deceleration control (m=3) is discriminated. If step 508 decides the other way, it indicates that the acceleration pedal angular speed $\theta_{ac}$ is not larger than its threshold value $\theta_{acd}$ and that the speed v is "0", thereby representing a fault. The step 509, like step 515, thus raises an alarm and proceeds to the deceleration control (m=3).

If the decision at step 504 is that the relation $\theta_{ac}>0$ does not hold, step 517 decides if the speed v is larger than zero or not. If the answer at step 517 is "Yes", step 518 decides whether the brake pedal angle $\theta_{br}$ is larger than zero. If the answer is "No", the step 519 compares the engine speed N with the minimum deceleration speed Nd. If it is decided that N is larger than Nd at step 519, the deceleration control (m=3) (step 521) is decided, and in the other case, the air-fuel ratio control (m=1) (step 520). If step 518 decides that $\theta_{br}$ is larger than zero, by contrast, the process jumps to the step 521 to decide on the deceleration control (m=3).

If the decision at step 517 is that v is not larger than zero, the process proceeds to step 525 of deciding whether or not the vehicle is equipped with automatic transmission (AT), and if the decision is "YES", step 527 decides on the idle speed control (m=4). Whether or not the vehicle is equipped with AT is set at the time of mounting the control unit on the vehicle. If step 525 decides that the vehicle is not equipped with AT, it indicates that the vehicle is of manual transmission type with the acceleration pedal angle $\theta_{ac}$ open and the speed at zero, and therefore in order to prevent engine stall, an alarm is issued (step 526) and the idle speed control (m=4) is discriminated (step 527).

If the step 503 at the beginning of the flow chart decides that the torque transmission mechanism is off, step 522 decides whether the acceleration pedal angle $\theta_{ac}$ is larger than zero, and if the answer is "Yes", step 523 decides on the air-fuel ratio control (m=1). If the decision is the other way, step 524 decides on the idle speed control (m=4). This flow of operation achieves the function of the condition discrimination section 4.

Figure 6:
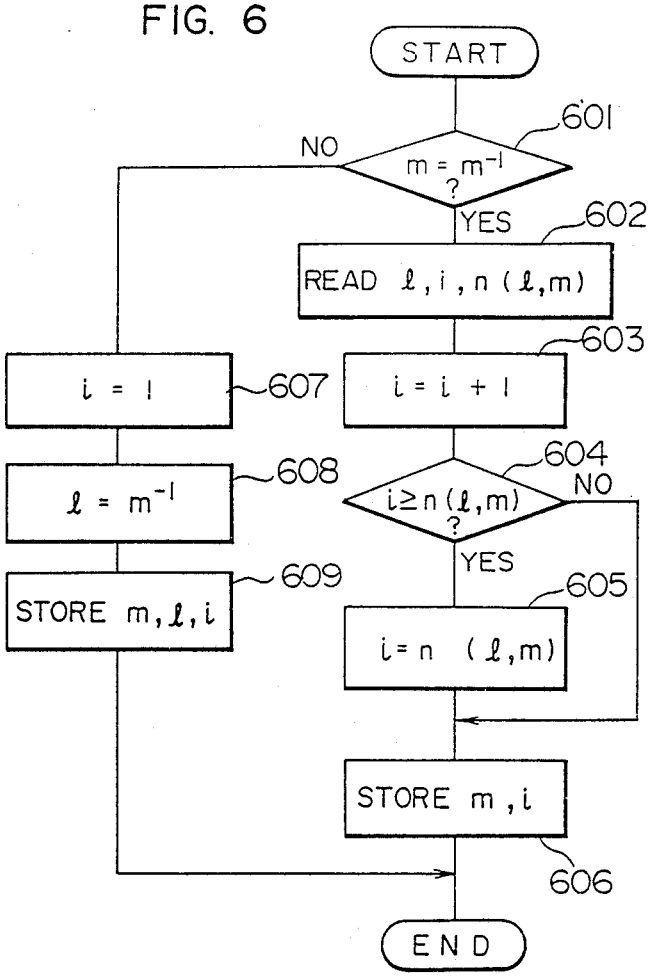
FIG. 6 is a flowchart for achieving the function of a history discriminator shown in FIG. 2.

The history judgement section 5 will be explained in detail with reference to the flowchart of FIG. 6. The control condition m at the present time received from the above-mentioned condition discrimination section 4 is compared with the immediately preceding control condition $m^{-1}$ at step 601. If they coincide with each other, step 602 reads the immediately preceding control condition l, the number i of detonations occurred from the start of transition (the number of samplings mentioned above), and the number n (l, m) of detonations for smoothing in the process of transition from the condition l to the condition m from the history file 7. Step 603 increases the value i, followed by step 604 for deciding whether $i \geqq n$ (l, m), and if the answer is "Yes", it is decided that the same condition is continued, so that the value i is restricted to the same value n (l, m) with the values m and i stored. If the decision at step 604 is "No", on the other hand, it is decided that the transition is undergoing, and the process jumps to step 606 thereby to store the values m, i as they are.

If the first step 601 decides that m is not equal to $m^{-1}$, "1" is set as the value of i (step 607), and the immediately preceding condition $m^{-1}$ is applied to l (step 608). These values m, l, i are stored. The history judgement is made by the afore-mentioned process flow, and the result of judgement is used for the process in the next mixing ratio compensation factor determining section 6.

Figure 7:
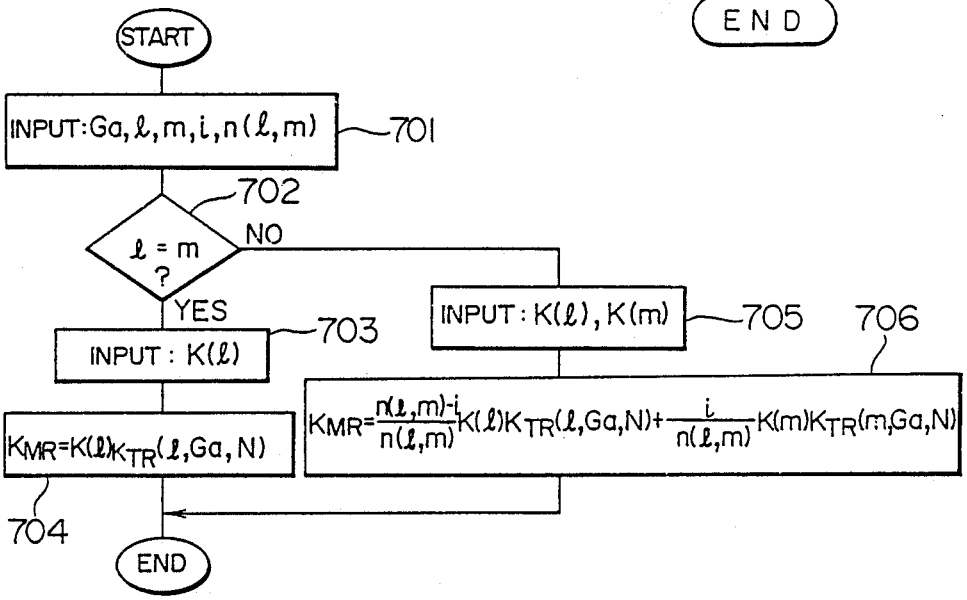
FIG. 7 is a flowchart for a mixing ratio compensation factor determination section 6 in FIG. 2.

FIG. 7 shows a flow configuration of a mixing ratio compensation calculation for achieving the function of the mixing ratio compensation factor determining section 6.

In the calculation of the mixing ratio compensation factor in FIG. 7, the section 6 is supplied with air flow rate Ga from the air flowmeter 24, the present control condition l from the above-mentioned history judgement section 5, the next control condition m, the number i of detonations occurred since the start of transition, and the number n (l, m) of detonations for smoothing in the process of transition from condition l to condition m at step 701. The next step 702 decides whether the same condition is continued (l=m), and if the same control condition is continued, step 703 applies the mixing ratio adaptation coefficient k (l) corresponding to the engine control condition l. Then, the mixing ratio compensation factor $K_{MR}$ is calculated from equation (1) on the basic of the mixing ratio target coefficient $K_{TR}$ (l, Ga, N) determined by the control condition l, air flow rate Ga and engine speed N and the mixing ratio adaptation coefficient K (l).

$$K_{MR} = K(l) \cdot K_{TR}(l, Ga, N) \quad (1)$$

If step 702 decides that the control condition is under transition from l to m, the process proceeds to step 705 for application of the mixing ratio adaptation coefficients K(l) and K(m) for the conditions l and m respectively. Step 705 calculates the weighted average of the mixing ratio target coefficient $K_{TR}$ (l, Ga, N) for the control condition l and the mixing ratio target coefficient $K_{TR}$ (m, Ga, N) for the control condition m in the manner shown in equation (2) thereby to determine the mixing ratio compensation factor $K_{MR}$ under transition.

$$K_{MR} = \frac{n(l, m) - i}{n(l, m)} K(l)K_{TR}(l, Ga, N) + \frac{i}{n(l, m)} K(m)K_{TR}(m, Ga, N) \quad (2)$$

Figure 8:
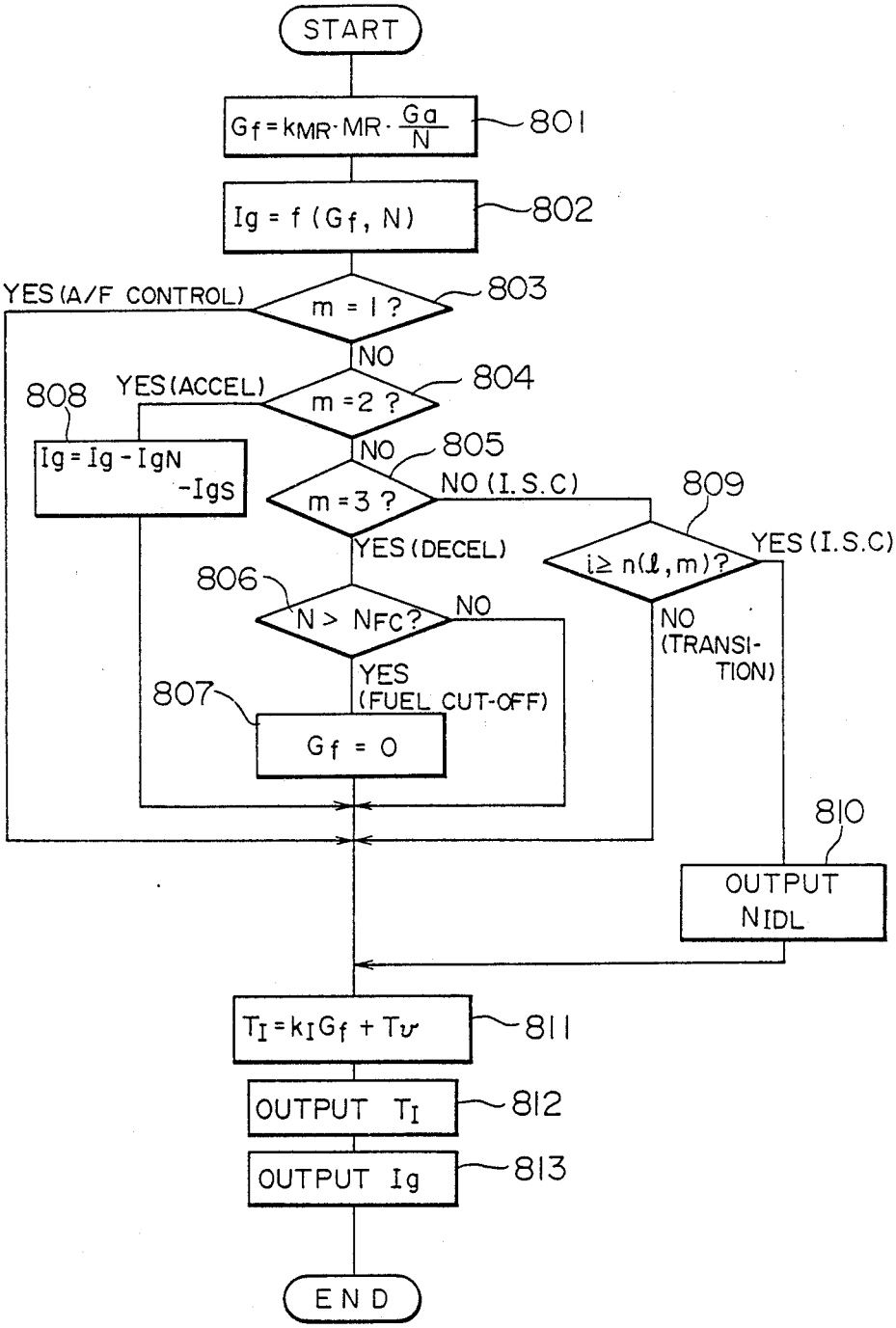
FIG. 8 is a flowchart for an air-fuel ratio control section 8, an acceleration control section 9, a deceleration control section 10, an idle speed control section 11 and an output section 12 in FIG. 2.

By use of the mixing ratio compensation factor $K_{MR}$ produced by the foregoing steps, one of the air-fuel ratio, acceleration, deceleration and idle speed controls 8, 9, 10, 11 is effected as shown at steps 801 to 809 in FIG. 8, and further followed by the processing at the output section 12 shown by steps 810 to 813 in the same diagram.

Step 801 calculates the amount of fuel injection Gf from the predetermined mixing ratio compensation factor $K_{MR}$, stoichiometric mixing ratio MR, air mass flow rate Ga and engine speed N in the manner shown by equation (3) below.

$$Gf = K_{MR} \cdot MR \cdot \frac{Ga}{N} \quad (3)$$

Step 802 determines the ignition timing Ig from the equation (4) below as a function of the fuel injection amount of Gf and the engine speed N in the well-known manner.

$$Ig = f(Gf, N) \quad (4)$$

If step 803 decides that m=1, A/F control is involved. While in the case that step 803 decides m is not 1, the process proceed to step 804.

If step 804 decides that m=2, that is, the acceleration control is involved, then step 808 makes knocking compensation IgN and surging compensation IgS for preventing the knocking or surging, as the case may be, with the acceleration, thereby calculates the ignition timing Ig from equation (5) below for smoothing the acceleration.

$$Ig = Ig - IgN - IgS \quad (5)$$

In the acceleration control, the value l or s is used as n (l, m) for the requirement of response of the engine with acceleration.

If step 805 decides that m=3, the engine speed N is compared with the fuel cut-off start engine speed $N_{FC}$, and if the engine speed is excessive, that is, if N is larger than $N_{FC}$, step 807 cuts off the fuel supply. In this control step, Gf is set to zero, and the ignition timing indicated by equation (4) is used.

If step 804 decides that m is not 3, and that m=4, it indicates the idle speed control, so that the process proceeds to step 809 for deciding whether i≧n (l, m) by comparing the number i of detonations from the start of transition start with the number n (l, m) of detonations for smoothing in the process of transition from condition l to condition m. If the decision at this step is "No", it indicates that i is smaller than n (l, m), in which case the transition is under way to the idle speed control. During the transition, the air-fuel ratio control is effected for producing the calculation values of Gf and Ig from equations (3) and (4). Upon completion of this transition process and if step 809 decides that the decision thereat is "Yes", step 810 effects the well-known feedback control for regulating the engine speed N to the target value $N_{IDL}$. This idle speed control is effected in such a manner that $N_{IDL}$ is applied to the air regulator 58 thereby to regulate the air flow rate of the bypass 56 to attain the engine speed of $N_{IDL}$.

Explanation will be made of the functions of the steps 811 to 813 and the output section 12. First, step 811 determines the fuel injection time $T_I$ of the injector from the value Gf, coefficient $k_I$ and the ineffective injection time Tv of the injector obtained in the steps 801 to 807 as shown below, $$T_I = k_I Gf + Tv \quad (5)$$

and applies this value to the fuel injection unit 2 (steps 811, 812). The ignition timing Ig is converted into an electrical signal (pulse train) and applied the ignition timing unit 3 (step 813).

In accordance with the control values thus obtained, the engine 1 is controlled, and the amount of oxygen in the exhaust gas is measured by the linear oxygen sensor 90 for use in the calculation at the mixing ratio adaptation coefficient updating section.

Figure 9:
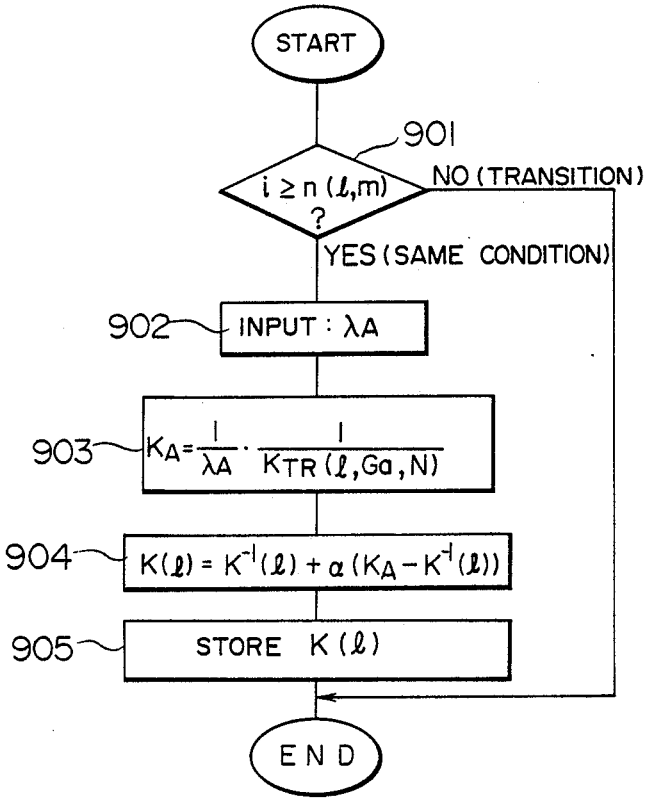
FIG. 9 is a flowchart for a mixing ratio adaptation coefficient updating section 14 in FIG. 2.

The function of the mixing ratio adaptation coefficient updating section will be explained with reference to the flowchart of FIG. 9. Step 901 decides whether the condition transition is under way (i<n (l, m)?), and if the answer is affirmative, the operation is completed without updating the mixing ratio adaptation coefficient. If the decision at step 901 is that the same control condition (i≧n (l, m)) is undergoing, step 902 supplies the air excess rate λA in the exhaust gas from the linear oxygen sensor 90. Step 904 calculates the mixing ratio adaptation coefficient observation value $K_A$ from the input λA and the mixing ratio target coefficient $K_{TR}$ (l, Ga, N) used in the fuel injection calculation in the manner shown in equation (6).

$$K_A = \frac{1}{\lambda A} \cdot \frac{1}{K_{TR}(l, Ga, N)} \quad (6)$$

This observation value $K_A$ is liable to contain a measurement noise or measurement error, and in order to extract reproducible data from the observation data, step 904 smooths the mixing ratio adaptation coefficient K(l) by the adaptation coefficient $K^{-1}(l)$ for the immediately preceding sampling time and the smoothing gain α (0≦α≦1) as shown in the equation (7).

$$K(l) = K^{-1}(l) + \alpha(K_A - K^{-1}(l)) \quad (7)$$

The updated value of the mixing ratio adaptation coefficient thus produced at steps 901 to 904 is stored in the history file 7 (step 905).

The operating timing and data supply and delivery at each part of the control unit 15 will be explained with reference to FIG. 2. The control unit 15 has a computer built therein, which computer has a task controller for scheduling and starting programs (tasks). The method of program control which is well known is not shown.

The task controller contained in the unit 15 energizes the condition discrimination section 4 (as seen from the flowchart of FIG. 5) immediately before the start of fuel injection at each cylinder with the rotational sensor 108 as a timing monitor. Upon completion of the process of FIG. 5, the task controller starts the history judgement section 5 (as seen in FIG. 6). The engine control condition m is delivered from the condition discrimination section 4 to the history judgement section 5. The history judgement section 5 receives the data $m^{-1}$, l, i, n (l, m) on the immediately preceding sample from the history file 7, and stores the result of calculation in the form of m, l, i in the history file 7. At the end of the processing at the history judgement section 5, the mixing ratio compensation factor determining section 6 (as seen in FIG. 7) is energized. The mixing ratio compensation factor determining section 6 receives l, m, i, n (l, m) as data from the history judgement section 5, and measuring the amount of intake air flow Ga, receives the value k(l) from the history file 7. At the end of the process at the mixing ratio compensation factor determining section 6, the control unit 13 is energized. In the process, the control unit 13 receives data Ga, m, i, n (l, m). The result of calculation at the control unit 13 that is, Gf, Ig and $N_{IDL}$ are delivered to the output section 12. These data are converted into physical values at the output section 12 and supplied to the fuel injection control unit 2 and the ignition timing control unit 3. The control units 2, 3 produce an output in synchronism with the engine speed. The task controller energizes the mixing ratio adaptation coefficient updating section 14 (as seen in FIG. 1) at a time point where the detonation process ends. The mixing ratio adaptation coefficient updating section 14 receives the measured data of the air excess rate λA and reads the previous mixing ratio adaptation coefficient $k^{-1}(l)$ from the history file 7 and stores the updated value k(l) thereof in the file 7.

It will thus be understood from the foregoing description that according to the present invention, the vehicle conditions and the driver's intent are detected at each time, and according to the result thereof, an engine control system to be employed is determined accurately. As a result, the present invention contributes to an improved driveability, an improved selection of an operating range which varies with vehicle types, an improved matching efficiency of a control system capable of making the most of the engine performance and an improved efficiency of software development for realizing them.

Specifically, the desired value of air-fuel ratio can be always maintained in each engine control condition and in the transition between different engine control conditions. Therefore, the variation in the exhaust gas characteristics is reduced and the fuel economy is improved.

At the same time, less torque variations and vehicle vibrations with air-fuel ratio improve the driveability and riding comfort.

Also, since the proper mixing ratio target coefficient $K_{TR}$ (l, Ga, N) can be selected for each engine control condition in accordance with the driver's preference, a vehicle with superior driveability or high economy as compared with the prior art is realized, thereby meeting different requirements of individual drivers.

At the time of matching the engine control system, the above-mentioned n (l, m) is adjusted individually for each transition thereby to improve both the driveability and riding comfort of the vehicle in the process of condition transition while at the same time reducing the work loads for matching.

In transition to the acceleration control, for example, the value of n (l, m) which is normally set within the range from 1 to 30 is set to 1, whereby the response is improved even at the sacrifice of the driving smoothness.

We claim:

1. An adaptive control system for controlling an engine of a vehicle in a plurality of categorized conditions, comprising:

a plurality of driving operation sensors for detecting a driving operation of the vehicle taken according to a driver's intent;

a plurality of operating condition sensors including a linear oxygen sensor for detecting operating conditions of the vehicle and the engine;

a plurality of actuators for controlling means for operating the engine;

condition discrimination means for determining one of engine control conditions from the detected results of the driving operation sensors and the operating condition sensors;

a history file for storing past engine control conditions;

history judgment means for judging whether the engine control condition at present is in a continuation of same engine control condition or in a transition process between different engine control conditions by comparing a past engine control condition retrieved from the history file with the engine control condition determined by the condition discrimination means;

control parameter determining means for determining engine control parameters from the result of judgment of the history judgment means and from an adaptive parameter retrieved from the history file updating means by use of a weighting process corresponding to a degree of transition between control conditions when the history judgment means judges that the engine is in said transition process between different ones of said plurality of engine control conditions, wherein the degree of transition between said different ones of said plurality of engine control conditions is determined from the ratio between a predetermined number of engine detonations needed for a smooth transition between said different ones of said plurality of engine control conditions and a number of engine detonations that has occurred from a first detonation at the start of said transition process;

control means having a plurality of control modes corresponding to said control conditions for applying an operating signal to each of the plurality of actuators on the basis of the control parameters determined by the control parameter determining means in each control mode in accordance with the engine control condition discriminated by the condition discrimination means; and adaptive parameter updating means for receiving a control response parameter from the output of the operating condition sensors and for calculating an updated value of the adaptive parameter and for storing the updated value of said adaptive parameter in the history file.

2. An adaptive control system for categorized conditions of an engine according to claim 1, wherein said plurality of engine control conditions include an air-fuel ratio control condition, acceleration control condition, deceleration control condition and idle speed control condition, and the control modes include an air-fuel ratio control mode, acceleration control mode, deceleration control mode and an idle speed control mode.

3. An adaptive control system according to claim 1, wherein the control parameter determining means determines a fuel-air mixing ratio compensation factor as said control parameter.

4. An adaptive control system according to claim 1, wherein said control means includes means for calculating an amount of fuel injection and an ignition timing for each control mode of the control means.

5. An adaptive control system according to claim 1, wherein said linear oxygen sensor is used for measuring the amount of oxygen in the engine exhaust gas as said control response parameters, and said adaptive parameter updating means calculates an updated value of a mixing ratio adaption coefficient as said adaptive parameter and stores the updated value in the history file.

6. An adaptive control system according to claim 1 wherein said driving operation sensors include an acceleration pedal angle sensor, a brake pedal angle sensor and a torque interruption sensor.

7. An adaptive control system according to claim 1, wherein said operating condition sensors include a vehicle speed sensor, an engine speed sensor and an air mass flow rate sensor.

8. The adaptive control system according to claim 1, wherein said control parameter determining means determines a fuel-air mixing ratio compensation factor as said control parameter and said adaptive parameter updating means receives the output of said linear oxygen sensor as said control response parameter.

9. An adaptive system controlling an engine of a vehicle operating in a plurality of categorized conditions, comprising:

a plurality of driving operation sensors for detecting a driving operation based on a driver's actions carried out in driving the vehicle;

a plurality of operating condition sensors including a linear oxygen sensor for detecting operating conditions of the vehicle and engine;

a plurality of actuators for controlling means for operating the engine;

condition discrimination means for predicting and discriminating an engine control condition of said categorized engine control conditions from the output of the said driving operation sensors and said operating condition sensors;

a history file for storing past engine control conditions;

history judgment means for judging whether the engine is in one of said categorized engine control conditions or in a transition state between different categorized engine control conditions;

control parameter determining means for determining an engine control parameter during transition between first and second engine control conditions including means for calculating said control parameter from first and second target control parameters and corresponding adaptive parameter by a weighting process corresponding to a degree of transition between said first and second engine control conditions wherein said calculating means calculates said control parameter by said weighting process on the basis of said first target control parameter and said corresponding adaptive parameter being received from storage in the history file for said first engine control condition and on the basis of said second target control parameter and said corresponding adaptive parameter for said second engine control condition, and further wherein the degree of transition between said first and second engine control conditions is determined by a ratio between a predetermined number of engine detonations needed for a smooth transition from said first engine control condition to said second engine control condition and a number of engine detonations that has occured from a first detonation at the start of said transition;

control means having a plurality of control modes corresponding to said control conditions for applying an operating signal to each of the plurality of actuators on the basis of said control parameter for each of said control modes; and adaptive parameter updating means for receiving a control response parameter from the output of said operating condition sensors and for calculating an updated value of an adaptive parameter for each of said engine control conditions, and storing each of said updated value in the history file as said corresponding adaptive parameters for each of said engine control conditions.

10. The adaptive control system according to claim 9, wherein said control parameter determining means determines a fuel-air mixing ratio compensation factor as said control parameter by a weighted value of the sum of first and second produces of said target mixing ratio and said mixing ratio adaptation coefficient for each of said first and second engine control conditions respectively, wherein each said produce is modified by said ratio such that the value of said first product contributes more to said weighted value at the start of said transition than at the end of said transition; and wherein the value of said second product contributes more to said weighted value than said first product at the end of said transition whereby said mixing ratio compensation factor changes according to the degree of transition between said first and second engine control conditions.

11. An adaptive control system according to claim 10, further comprising:

said engine having means for controlling the injection of fuel into cylinders of said engine and means for controlling the timing of said engine; and said control means receives said mixing ratio compensation factor and controls said fuel injection control means and said ignition timing control means in accordance with said mixing ratio compensation factor.

* * * * *